US005130408A

United States Patent [19]

Deeg

[11] Patent Number: 5,130,408

[45] Date of Patent: * Jul. 14, 1992

[54] AROMATIC POLYETHERKETONE MULTIFILAMENT YARNS

[75] Inventor: Martin H. G. Deeg, Maplewood, N.J.

[73] Assignee: Hoechst Celanese Corporation, Somerville, N.J.

[ * ] Notice: The portion of the term of this patent subsequent to Apr. 4, 2006 has been disclaimed.

[21] Appl. No.: 547,398

[22] Filed: Jul. 3, 1990

Related U.S. Application Data

[60] Continuation of Ser. No. 184,090, Apr. 20, 1988, abandoned, which is a division of Ser. No. 744,858, Jun. 14, 1985, abandoned, which is a continuation-in-part of Ser. No. 732,537, May 10, 1985, abandoned.

[51] Int. Cl.[5] ..... C08G 8/02; C08G 65/38; D01F 1/00; D01F 6/00

[52] U.S. Cl. ..... 528/125; 528/126; 528/128; 528/219; 264/176.1; 264/205; 264/211.22; 428/364

[58] Field of Search ..... 528/125, 126, 128, 219; 264/176.1, 211.22, 205; 428/364

[56] References Cited

U.S. PATENT DOCUMENTS

| | | | |
|---|---|---|---|
| 4,320,224 | 3/1982 | Rose et al. | 528/219 |
| 4,360,630 | 11/1982 | Smith | 528/125 |
| 4,849,148 | 7/1989 | Deeg | 528/125 |
| 4,954,605 | 9/1990 | Deeg | 528/125 |

FOREIGN PATENT DOCUMENTS 57-191322 11/1982 Japan .

OTHER PUBLICATIONS

Ali et al., "Spinning and Drawing of Polyetheretherketone (PEEK)," Research Disclosure 216, 104–5 (Apr. 1982).

Xu et al., Poly (ether-ether-ketone): Melt spinning and Fiber Properties, Sen-I Gakkaishi 41 (1):59-65 (1985) (English translation provided).

*Primary Examiner*—John Kight, III
*Assistant Examiner*—P. Hampton-Hightower
*Attorney, Agent, or Firm*—Robert H. Hammer, III

[57] ABSTRACT

Filaments are produced from polymers having an inherent viscosity of at least 0.7 measured in concentrated sulfuric acid and containing in the polymer chain at least 50 percent of the repeating units:

by melting the polymer and heating the melt to a temperature of from about 20° C. to about 80° C. above the melting point of the polymer, passing the melt through a filter pack having a filtering area of at least about 8 $in^2$ and a total volume of at least about 1.2 $in^3$ per pound of polymer extruded per hour, and containing inert, irregularly shaped particles having a mesh size of about 25 to 140 to provide a pressure drop at least about 800 psig., extruding the melt through spinning openings of desired shape to form filaments and passing the filaments immediately upon extrusion through a heating zone maintained at a temperature of about 200° to 320° C. and having a length of about 3 to 12 inches. The process is capable of producing fibers and yarns having a dpf of about 2.8 to just below 15, a tenacity of about 1 to 4.5 grams per denier, an elongation at break of about 15 to 200 percent and a modulus of about 20 to 80 grams per denier.

3 Claims, 1 Drawing Sheet

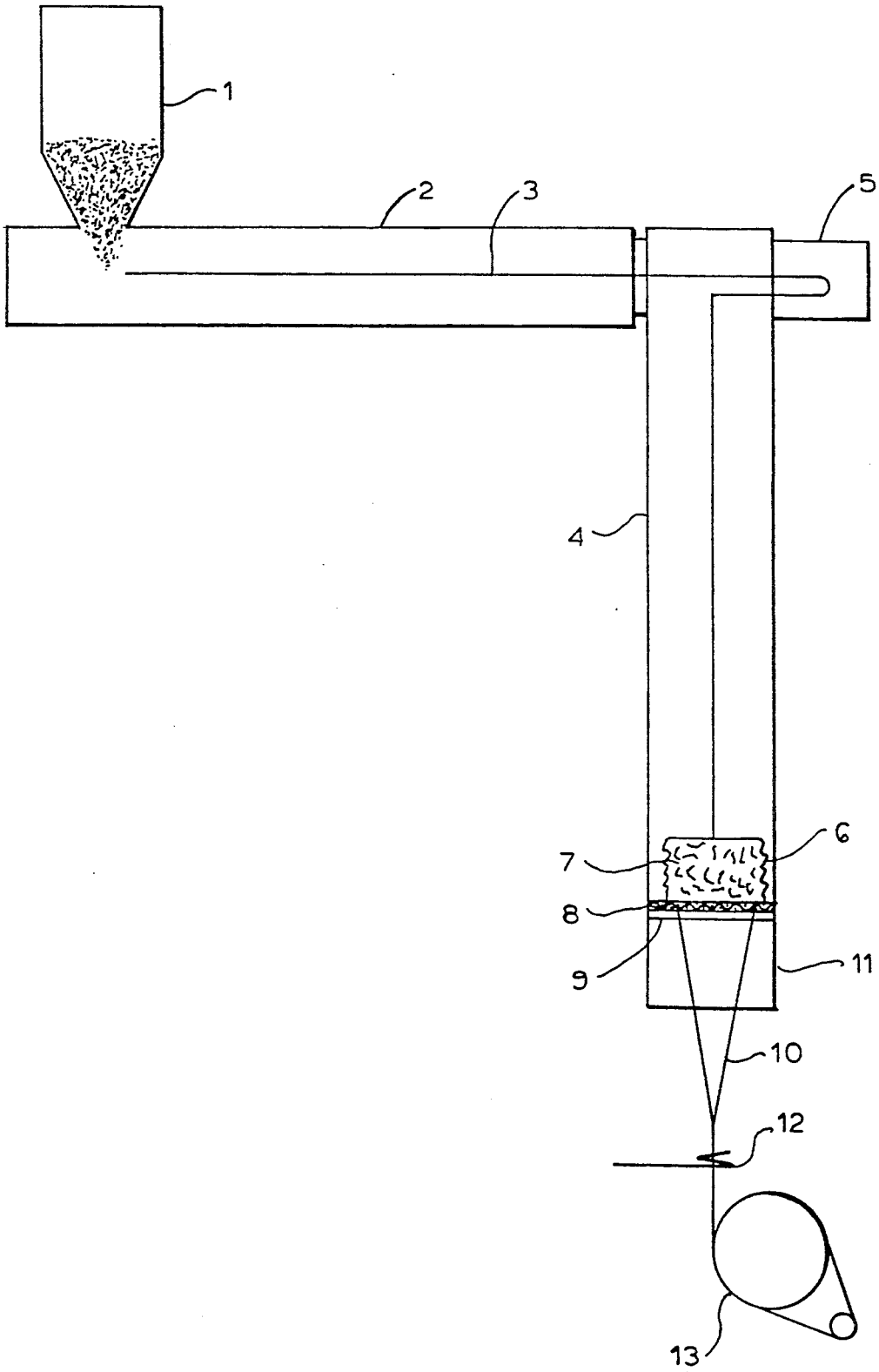
1
2
3
5
4
6
7
8
9
11
10
12
13

AROMATIC POLYETHERKETONE MULTIFILAMENT YARNS

This invention was made with Government support under Contract No. F3315-84-C-5043 awarded by the Department of Defense (DOD). The Government has certain rights in this invention.

CROSS REFERENCE TO RELATED APPLICATIONS

This application is a continuation of application Ser. No. 07/184,090, filed Apr. 20, 1988, abandoned which is a divisional of application Ser. No. 06/744,858, filed Jun. 14, 1985, now U.S. Pat. No. 4,747,988, issued May 31, 1988 which in turn is a continuation-in-part of application Ser. No. 06/732,537, filed May 10, 1985, and now abandoned.

This invention relates to filaments and fibers of a certain class of aromatic polyetherketones and their production by a melt spinning process.

BACKGROUND OF THE INVENTION

The polymers contemplated by this invention are disclosed in U.S. Pat. Nos. 4,320,224; 4,360,630; and 4,446,294, the entire disclosures of which are incorporated by reference. These crystalline, linear polymers contain in the polymer chain at least 50 percent of the following repeating unit (hereinafter referred to as "repeating unit I"):

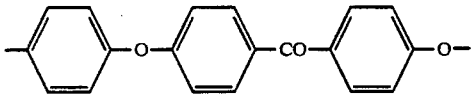

The polymers may be composed solely of repeating units I or may contain other repeating units as hereinafter defined and they have inherent viscosities IV (measured at 25° C. in a solution of the polymer in concentrated sulphuric acid of density 1.84 g $cm^{-3}$, said solution containing 0.1 g of polymer per 100 $cm^3$ of solution) of at least 0.7. These polymers are exceptionally useful in that they possess excellent mechanical and electrical properties, coupled with outstanding thermal and combustion characteristics. They also show resistance to a very wide range of solvents and proprietary fluids. They are thus very suitable in applications where the service conditions are too demanding for the more established, high performance polymers and in particular where the polymers are liable to high service temperatures.

In view of the foregoing desirable properties of these particular aromatic polyetherketones, it would be advantageous if they could be easily formed into filaments and fibers since the latter products could then be made for example into knitted, woven and non-woven fabrics, fiberfill and insulation products suitable for applications utilizing their excellent physical and chemical properties. However, the same combination of properties which would make filaments and fibers made from these polymers very desirable in various applications, e.g. heat and solvent resistance, also cause them to be very difficult to spin into such filaments and fibers, particularly those of relatively low denier. Thus, if it is attempted to melt spin these polymers into filaments in a conventional manner, the use of a relatively low spinning temperature results in a high melt viscosity which significantly reduces spinning stability due to high spinning pressures, clogging of the spinneret holes, uneven polymer coagulation and frequent filament rupture. On the other hand, unduly high spinning temperatures result in polymer degradation and cross-linking which cause void, gel and speck formation in the filaments and render them unsuitable for most uses. In view of these factors, successful spinning into filaments of the polymers contemplated by this invention, particularly filaments of relatively low denier, is not easily accomplished. Although U.S. Pats. Nos. 4,320,224, and 4,446,294 disclose broadly that polymers containing a major proportion of repeating unit I may be fabricated into any desired shape including fibers, they do not have any specific teaching of how such fibers may in fact be formed.

A BRIEF DESCRIPTION OF THE DRAWING

The drawing is a schematic depiction of the spinning apparatus used to produce the fibers disclosed herein.

SUMMARY OF THE INVENTION

Copending application Ser. No. 732,537, filed May 10, 1985, and now abandoned, discloses a process wherein a linear aromatic polyetherketone comprising at least 50 percent of repeating unit I in the polymer chain and having an inherent viscosity ("IV") of at least 0.7 as hereinbefore defined is melt spun at a temperature in the range of from about 20° C. above to about 80° C. above the melting point of the polymer, using a filter pack filtering area of at least about 8 $in^2$ preferably about 15 to 25 $in^2$ and a total volume of at least about 1.2 $in^3$, preferably about 1.6 to 2.3 $in^3$ per pound of polymer extruded per hour using a filtering medium of inert particles having numerous angles, indentations and/or irregularities and a mesh size of about 25 to 140. The particles of filter medium may be for example "shattered metal" e.g., of carbon steels and stainless steels, aluminum oxides and silicates, e.g. sold under the trademarks "Alundum" and "Bauxilite", ground ceramics and sand.

The filter medium utilized in the foregoing process must be sufficient to provide a pressure drop of at least about 800 psig. preferably about 950 to 3000 psig. Such a filter pack size and type of filter medium has been found to provide an adequate degree of shear necessary for stable spinning of the contemplated polymers without an undesirably large increase in spinning pressure.

While the foregoing described process is adequate for the formation of yarns of relatively higher dpf (denier per filament), e.g. up to 100, it cannot be easily used for the production of yarns of relatively lower dpf, e.g. below about 15 dpf. The reason for this is that the polymer which is high melting rapidly solidifies as it is extruded into ambient conditions, and drawdown to relatively lower dpf's is severly limited.

In accordance with this invention, an improvement in the foregoing spinning process is provided whereby the extruded filaments are heated by passing them through a heating zone, e.g. a heated tube or shroud, immediately on being extruded through the spinneret holes. This prevents the filaments from solidifying too rapidly and allows for the drawdown of the filaments to deniers considerably lower than would otherwise be possible.

If a heated tube is utilized to heat the filaments, it may be made of any material capable of withstanding the temperatures employed which will generally be in the range, for example, of about 200° to 320° C., preferably about 290° to 310° C. Such material may be, for example, metal, e.g. aluminum or steel, ceramic or glass. Any conventional heating means may be used, e.g. electrical heating elements, steam, hot liquid or gas etc. A specific heated tube assembly which may be used is an aluminum tube inclosed in a steel heater band.

The diameter of the heating zone, e.g. the heated tube is generally the same as the spinneret, e.g. about 1½ to 5 in., preferably about 3 to 4½ in. and the length is in the range, for example, of about 3 to 12 inches, preferably about 5 to 8 inches and most preferably 6 inches.

In addition to the filter medium mentioned previously, it is in most instances desirable to employ a fine filter screen across the filtering area downstream of the filter for the purpose of separating specks and gels which get through the filter pack. Such a screen in general has openings of under about 20 microns, preferably in the range of about 3 to 10 microns.

In order to further maintain stable spinning in carrying out the process of the invention, it is preferable not to quench the filaments extruded from the spinneret holes, i.e. the filaments are cooled in non-circulating air at ambient temperatures and are not contacted with any forced draft of any gas cooler than the surroundings. Moreover, to maintain stable spinning, it is preferable to operate the process such that the extruded filaments converge within about 15 to 50 inches, preferably in the range of about 20 to 30 inches of the spinneret.

The remaining conditions which may be utilized in the process are conventional for melt spinning and are not considered critical to the invention. Thus the polymer may be extruded through a spinneret plate containing, for example 10 to 100 holes each with a diameter in the range of about 0.009 to 0.013 inch to produce filaments which are taken up at a speed, for example of about 50 to over 1000 meters per minute. Such filaments each has a denier, for example in the range of about 2.8 to 40, preferably about 2.8 to 15, The filaments may have a circular cross-section resulting from the use of circular spinneret holes, or may have any of various non-circular cross-sections resulting from the use of different non-circular spinneret hole shapes, e.g. multilobal cross-sections containing, for example, six lobes, produced by using star-shaped spinneret holes containing, for example six protrusions.

The yarns resulting from the process of this invention generally have a tenacity in the range of about 1 to 4.5 grams per denier, an elongation at break of about 15 to 200 percent and modulus of about 20 to 80 grams per denier. The birefringence of the filaments is in the range of about 0.025 to 0.220. The process of this invention is particularly useful in the production of yarns having the foregoing mechanical properties and dpf's under 15, for example from about 2.8 to just under 15, e.g. from about 2.8 to 14.8.

The preferred polymers which may be formed into filaments in accordance with this invention consist solely of repeating unit I and have an IV of a least 0.7 measured in concentrated sulfuric acid as described previously. As disclosed in U.S. Pat. No. 4,320,224, such polymers may made by polycondensing hydroquinone and 4,4'-difluorobenzophenone with an alkali metal carbonate or bicarbonate (excluding the sole use of sodium carbonate or biocarbonate) in a solvent such as diphenyl sulfone. Part of the 4,4' difluorobenzophenone e.g. up to 50 percent, may be replaced with 4,4'-dichlorobenzophenone or 4-chloro-4'fluorobenzophenone. These polymers consisting solely of repeating units I in the polymer chain generally have a melting point of about 335° C. so that in carrying out the spinning process of the invention, the polymer melt is extruded at temperatures of about 355° C. to about 385° C. Polymers containing up to 50 percent of repeating units other than repeating unit I are also contemplated and may be formed by replacing up to 50 mol percent of the hydroquinone in the monomer mixture with any of certain other dihydroxyphenols and up to 50 mol percent of the 4,4'-difluorobenzophenone with any or certain other aromatic dihalides. For example, up to 50 mol percent of the hydroquinone may be substituted with a dihydroxy phenol cocondensant of the formula:

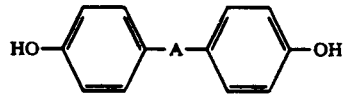

In which A is a direct link, oxygen, sulphur, $SO_2$—, —CO—, or a divalent hydrocarbon radical. Examples of such bisphenols are:

4,4-dihydroxybenzophenone
4,4'-dihydroxydiphenylsulphone
2,2'-bis(4-hydroxyphenyl) propane
4,4'-dihydroxybiphenyl The substitution of part of the hydroquinone with any of the foregoing dihydroxy phenols causes the following repeating units (hereinafter referred to as "repeating unit II") to be present in the polymer chain interspersed with repeating unit I:

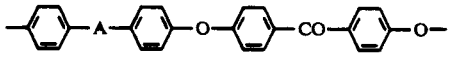

Alternatively or in addition to the substitution of part of the hydroquinone with another dihydroxyphenol, up to 50 mol percent of the 4,4'-difluorbenzophenone may be replaced with one or more dihalide cocondensants of the formula:

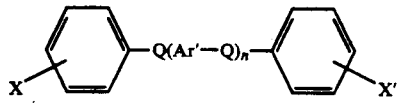

in which X and X', which may be the same or different, are halogen atoms and are ortho or para —preferably the latter—to the groups Q and Q'; Q and Q', which may be the same or different, are —CO— or —$SO_2$—; Ar' is a divalent aromatic radical; and n is 0, 1, 2 or 3.

The aromatic radical Ar' is preferably a divalent aromatic radical selected from phenylene, biphenylylene or terphenylylene.

Particularly preferred dihalides have the formula:

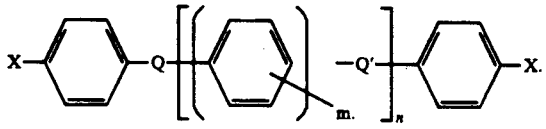

where m is 1, 2 or 3.

Examples of such dihalides include:

4,4-dichlorodiphenysulphone
4,4-difluorodiphenylsulphone
4,4'-dichlorobenzophenone
bis-4,4'-(4-chlorophenylsulphonyl) biphenyl
bis-1,4-(4-chlorobenzoyl) benzene
bis-1,4-(4-fluorobenzoyl) benzene
4-chloro-4'-fluorobenzophenone
4,4'-bis-(4-fluorobenzoyl) biphenyl
4,4'-bis-(4-chlorobenzoyl) biphenyl.

Although substitution of the 4,4'-difluorobenzophenone with 4,4'-dichlorobenzophenone and/or 4-chloro-4'fluorobenzophenone does not change the units of the polymer chain, it has been found that up to 50 mol percent of the difluoro compound may be so replaced without adverse effects and with consequent cost advantage. Substitution of part of the 4,4-difluorobenzophenone with any of the other specified dihalides cause the following units (hereinafter referred as "repeating unit III") to be present in the polymer chain

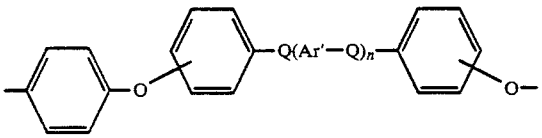

in which the oxygen atoms in the sub-units:

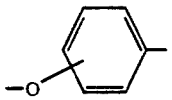

are ortho or para to the groups Q and Q'.

Where both dihydroxy phenol and dihalide (other than the dichloro- or chlorofluoro benzophenone) cocodensants are employed, the polymer will contain, in addition to repeating units I, II and III, the following repeating units (hereinafter referred to as "repeating unit IV"):

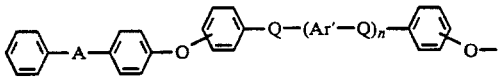

DESCRIPTION OF PREFERRED EMBODIMENTS

Example 1

Filaments were produced in accordance with the process of this invention using spinning apparatus as depicted schematically in the drawing. Polymer chip in an amount of 3.05 lb/hr. with polymer chains consisting solely of repeating unit I having an IV in concentrated sulfuric acid of 0.9 and prepared as described in Example I of U.S. Pat. No. 4,320,224, was fed to closed hopper I under nitrogen or vacuum. From there, it passed into screw extruder 2 which was heated by electrical heater bands divided into three zones. The polymer which followed the path indicated by line 3 was heated to 246° C. in the near section of the extruder, and melted and heated to 346° C. and 363° C. in the center and front sections respectively. The melted polymer was then passed into the top of "block" i.e. spinning chamber, 4 from which it was passed to pump 5 (a standard Zenith gear pump) and back into block 4 which was surrounded by electrical band heaters. The polymer melt, heated in block 4 to about 382° C., was passed into filter pack 6 which contained shattered metal filtering medium 7 in which the particles had a mesh size of about 25 to 50. The filter pack had a filtering area of over 20 $in^2$ and a total filter volume of about 2.75 $in^3$. The pressure drop of the polymer melt developed in the filter pack was about 1000 psig.. At the start of spinning from filter pack 7, the polymer melt passed through screen 8 having openings less than 20 microns in size and thence through the 33 holes of spinneret 9 arranged in a circle in the spinneret plate. The holes each had a diameter of 0.0127 inch and a length of 0.019 inch. Filaments 10 extruded from the spinneret passed immediately through heated tube 11 which had the same diameter as the outside of the spinneret, i.e. 4 in, a length of 6 in. and was at a temperature of 200° C. After passing through heated tube 10, the filaments were collected into a yarn at yarn guide 12 located about 24 inches below the spinneret. The yarn was taken up without quenching in 5 to 10 wraps around take up rolls 12 at a speed of about 225 meters per minute and was forwarded to a winder (not shown).

The resulting yarn and a dpf of 12.6 a tenacity of 1.66 grams/denier, an elongation at break of 72 percent and modulus of 27.86 grams/denier.

EXAMPLE 2

The procedure of Example 1 was followed except that the temperature of heated tube 11 was 217° C. and the yarn was taken up at a speed of 300 meters/min. The yarn had a dpf of 9.6, a tenacity of 1.59 grams/denier, an elongation at break of 65 percent and a modulus of 29.06 grams/denier.

EXAMPLE 3

The procedure of Example 1 was followed except that the temperature of heated tube 11 was 212° C. and the take-up speed of the yarn was 200 meters/min. The yarn had dpf of 13.9, a tenacity of 1.76 grams/denier, an elongation at break of 96 percent and a modulus of 25.69 grams/denier.

EXAMPLE 4

The procedure of Example 1 was followed except that the temperature of heated tube 11 was 218° C. and the yarn was taken up at a speed of 350 meters/min. The yarn had a dpf of 7.9, tenacity of 1.95 grams/denier, an elongation at break of 71 percent, and a modulus of 30.13 grams/denier.

EXAMPLE 5

The procedure of Example 1 was followed except that the temperature of heated tube 11 was 218° and the yarn was taken up at a speed of 325 meters/min. The yarn had a dpf of 8.9, a tenacity of 1.97 grams/denier, an elongation at break of 78 percent, and a modulus of 29.86 grams/denier.

EXAMPLE 6

The procedure of Example 1 was followed except that the temperature of heated tube 11 was 205° C. and the yarn take-up speed was 400 meters/min. The yarn had a dpf of 5.0, a tenacity of 2.07 grams/denier, an elongation at break of 65 percent and a modulus of 34.62 grams/denier.

EXAMPLE 7

The procedure of Example 1 was followed except that the temperature of heated tube 11 was 300° C. and the yarn was taken up at a speed of 510 meters/min. The yarn had a dpf of 5.7, a tenacity of 2.00 grams/denier, an elongation at break of 65 percent and a modulus of 30.95 grams/denier.

EXAMPLE 8

The procedure of Example 7 was followed except that the yarn take-up speed was 550 meters/min. The yarn had a dpf of 4.8, a tenacity of 2.21 grams/denier, an elongation at break of 61 percent and a modulus of 33.97 grams/denier.

EXAMPLE 9

The procedure of Example 7 was followed except that the take-up speed was 606 meters/min. The yarn had a dpf of 4.5, a tenacity of 2.15 grams/denier, an elongation at break of 5.7 percent and modulus of 32.90 grams/denier.

EXAMPLE 10

The procedure of Example 7 was followed except that spinneret 9 contained 72 holes arranged in a circle to produce 72 filaments and the yarn was taken up at a speed of 188 meters/min. The yarn had a dpf of 7.0, a tenacity of 2.11 grams/denier, an elongation at break of 90 percent, and a modulus of 27.47 grams/denier.

EXAMPLE 11

The procedure of Example 1 was followed except that spinneret 9 contained 100 holes each having a diameter of 0.008 inch and a length of 0.012 inch to produce 100 filaments, the temperature of heated tube 11 was 290° C., and the yarn take-up speed was 50 meters/min. The yarn had a dpf of 18.3, a tenacity of 1.53 grams/denier, an elongation at break of 160 percent and a modulus of 22.58 grams/denier.

EXAMPLE 12

The procedure of Example 11 was followed except that heated tube 11 was at a temperature of 300° C. and the yarn was taken up at a speed of 75 meters/min. The yarn had a dpf of 12.6, a tenacity of 1.41 grams/denier, an elongation at break of 112 percent and a modulus of 23.80 grams/denier.

EXAMPLE 13

The procedure of Example 11 was followed except that the temperature of heated tube 11 was 320° C. and the yarn take-up speed was 100 meters/min. The yarn had a dpf of 9.1, a tenacity of 1.55 grams/denier, an elongation at break of 94 percent, and a modulus of 25.25 grams/denier.

EXAMPLE 14

The procedure of Example 1 was followed except that the temperature of heated tube 11 was 313° C., the yarn was initially wound on take-up roll 12 at a speed of 355 meters/min. and was forwarded to a second roll capable of acting as a draw roll but in this case rotating at the same speed as take-up roll 12 i.e. 355 meters/min. From the draw roll which was at ambient temperature, the yarn was forwarded to the tension control winder. The yarn had a dpf of 7.5, a tenacity of 29.70, an elongation at break of 91 percent and a modulus of 29.70 grams/denier.

EXAMPLE 15

The procedure of Example 14 was repeated except that the draw roll was operating at a speed of 400 meters/minute providing for a drawing of the yarn of 12.7 percent at ambient temperature. The yarn had a dpf of 7.2, a tenacity of 2.13 grams/denier, an elongation at break of 78 percent and a modulus of 28.84 grams/denier.

EXAMPLE 16

The procedure of Example 15 was followed except that the draw roll was at a temperature of 200° C. The yarn had a dpf of 6.6, a tenacity of 2.37 grams/denier, an elongation at break of 66 percent and a modulus of 31.75 grams/denier.

EXAMPLE 17

The procedure of Example 16 was followed except that the take-up roll was operating a speed of 350 meters/min. and the draw roll at a speed of 425 meters/min. resulting in the yarn being drawn 21.4 percent. The yarn had a dpf of 6.9, a tenacity of 2.48 grams/denier, an elongation at break of 49 percent and a modulus of 37.29 grams/denier.

EXAMPLE 18

The procedure of Example 17 was followed except that the take-up roll operated at 300 meters/min. providing for a drawing of the yarn of 41.7 percent. The yarn had a dpf of 6.7, a tenacity of 3.19 grams/denier, an elongation at break of 32 percent and a modulus of 49.05 grams/denier.

EXAMPLE 19

The procedure of Example 17 was repeated except that the take-up roll operated at a speed of 278 meters/min. resulting in the yarn being drawn 45.7 percent. The yarn had a dpf of 6.4, a tenacity of 3.64 grams/denier, an elongation at break of 32 percent and a modulus of 57.84 grams/denier.

The yarn produced by the process of this invention may be subjected to a drawing treatment using techniques well-known in the art to increase its tenacity. Furthermore, the filaments and yarns produced by the disclosed process may be converted to other fiber products such as tow, staple fiber, staple spun yarn etc. by means of conventional methods.

The various fiber products which may be produced in accordance with the invention are suitable for a variety of end-uses requiring good high temperature performance. For example, they may be used in the preparation of high performance structural components, e.g. by blending with carbon fiber in the form of filament or staple spun yarns, knitting or weaving the blend into a fabric and heat pressing the fabric into the desired shape. The fiber oft he invention may also be used as a component of filter bags used in hostile environments and, in the form of knitted or woven fabrics, in the manufacture of various textile products requiring resistance to high temperatures such as specialized clothing, draperies and upholstery fabrics, e.g., those employed in airline seats.

I claim:

1. Multifilament yarns of a polymer having an inherent viscosity of at least 0.7 measured in concentrated sulfuric acid, said polymer containing in the polymer chain at least 50 percent of the repeating units:

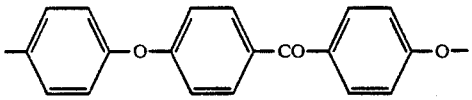

said yarns having at least ten filaments and a dpf of about 2.8 to just below 15, a tenacity of about 1 to 4.5 grams per denier, an elongation at break of about 15 to 200 percent, and a modulus of about 20 to 80 grams per denier.

2. The yarns of claim 1 wherein said polymer consists solely of said repeating units in the polymer chain.

3. The yarns of claim 1 wherein the individual fibers have a birefringence of about 0.025 to 0.220.

* * * * *